United States Patent [19]

King et al.

[11] Patent Number: 4,787,497

[45] Date of Patent: Nov. 29, 1988

[54] CONVEYOR SYSTEM FOR ROD-LIKE ARTICLES

[75] Inventors: Paul G. King; Anthony R. Brown, both of Bucks, Great Britain

[73] Assignee: Molins PLC, London, England

[21] Appl. No.: 889,613

[22] Filed: Jul. 28, 1986

[30] Foreign Application Priority Data

Jul. 29, 1985 [GB] United Kingdom ..... 8519096

[51] Int. Cl.[4] ..... B65G 1/00

[52] U.S. Cl. ..... 198/347; 131/282

[58] Field of Search ..... 198/347; 131/909, 282, 131/283

[56] References Cited

U.S. PATENT DOCUMENTS

| | | | |
|---|---|---|---|
| 2,997,828 | 8/1961 | Ahlbor | 198/347 X |
| 3,305,128 | 2/1967 | Dearsley | 198/347 X |
| 4,023,669 | 5/1977 | Clarke | 198/347 X |
| 4,200,181 | 4/1980 | Clarke | 198/347 X |
| 4,344,520 | 8/1982 | Czoch et al. | 198/347 |
| 4,368,742 | 1/1983 | Wahle et al. | 131/909 X |
| 4,574,938 | 3/1986 | Orlandi | 198/347 |

FOREIGN PATENT DOCUMENTS 2151218 7/1985 United Kingdom .

*Primary Examiner*—Robert J. Spar
*Assistant Examiner*—Cheryl L. Gastineau
*Attorney, Agent, or Firm*—Antonelli, Terry & Wands

[57] ABSTRACT

In a conveyor system for filter cigarettes in stack formation a boundary wall member for the stack is movable in a direction to compensate for tip build-up. In a preferred arrangement in the hopper of tray filler the member includes a flexible membrane (20) partially supported at one side, corresponding to the tobacco ends of the cigarettes, by a rigid backing member (28).

13 Claims, 1 Drawing Sheet

CONVEYOR SYSTEM FOR ROD-LIKE ARTICLES

Figures 1, 2:
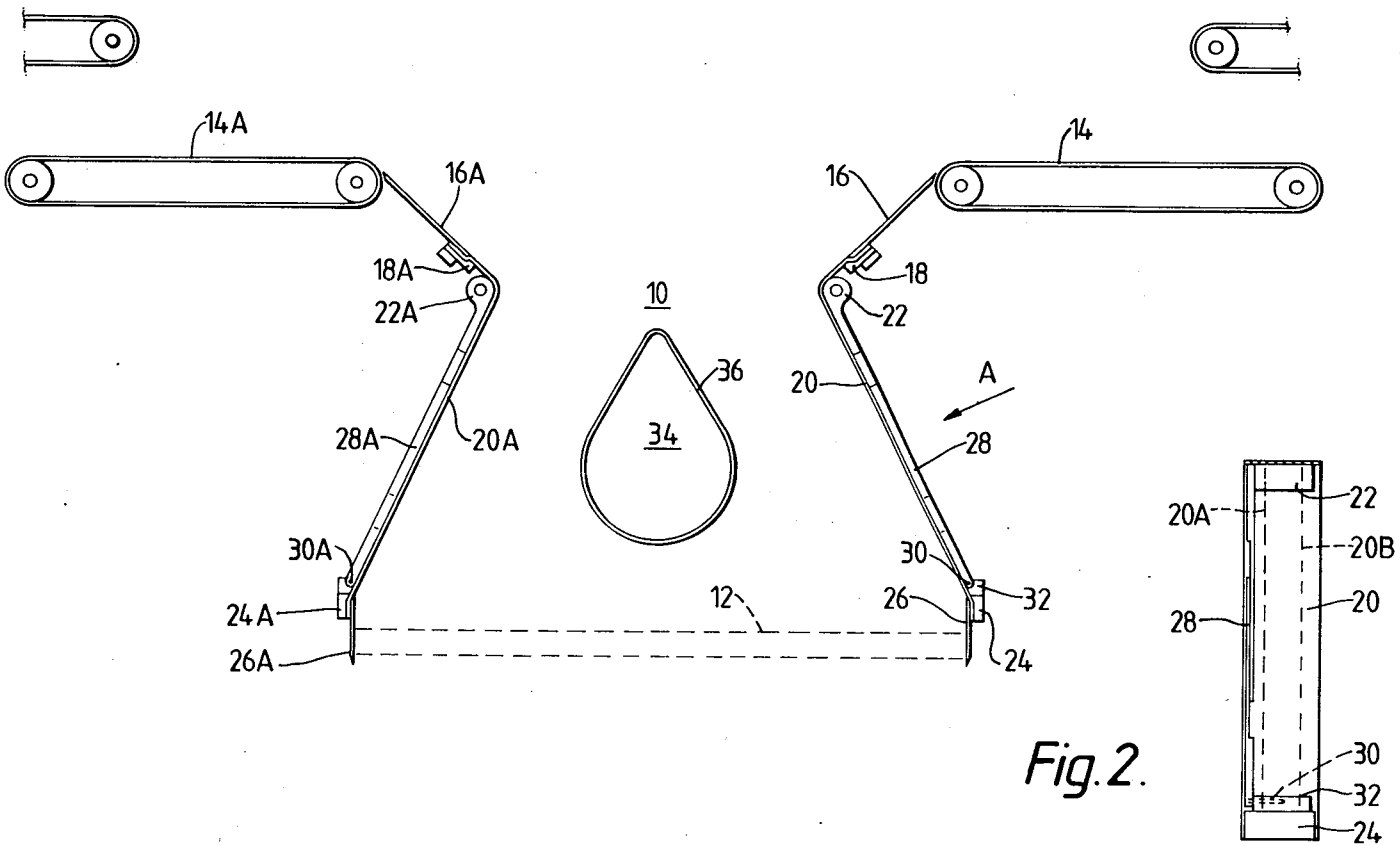

This invention relates to conveyor systems for rod-like articles, particularly filter cigarettes.

It is known that when filter cigarettes are assembled in multi-layer stack formation with the lowermost layer horizontal they tend to settle in a formation in which the upper layers of cigarettes are progressively more inclined with the filter ends of the cigarettes higher than the tobacco ends. This effect is known generally as tip build-up. It is caused by the slightly larger diameter of the filter ends of the cigarettes (due to the cork wrap) and also to some extent by the different compressibility or hardness of the tobacco and filter ends of the cigarettes. The effect is present also in planes other than a vertical plane; for example, in the absence of constraint a horizontal section through a stack of cigarettes would show the formation to be wedge-shaped.

Normally, when a multi-layer stack of cigarettes is assembled, for example in a hopper, it is required that the lowermost cigarettes should be horizontal and that the ends of the cigarettes should be in a vertical plane. If it is required to confine by means of an upper boundary wall element cigarettes above the lowermost layer it has been found that a problem can result if the element is arranged so that it is parallel to a plane passing through cigarettes in the lowermost layer (or at right angles to the vertical plane) since the element may then tend to contact the cigarettes at or near one end only (usually the filter tip end) due to tip build-up. In some circumstances this can allow those cigarettes close to the element to become misaligned, by pivoting about the point of contact or otherwise due to the absence of control of one end of the cigarettes. Once cigarettes become misaligned in a stack it requires operator intervention to remove the misaligned cigarettes. Apart from damaging itself and possibly other cigarettes in the vicinity, a misaligned cigarette, if not removed, can cause interruption in operation to or even damage of a machine through which the cigarettes are conveyed.

According to one aspect of the invention a conveyor system for rod-like articles, particularly filter cigarettes, comprises means defining a region through which articles pass in multi-layer stack formation, means supporting cigarettes in said region and establishing an orientation of a layer of cigarettes in said region, and means defining a boundary of said region in a position spaced from said layer of cigarettes, said boundary means being movable in a direction to compensate for tip build-up between said layer and said boundary means.

In a preferred arrangement the boundary means comprises a wall member which is flexible or semi-flexible at least in a direction allowing it to move in a direction to accommodate tip build-up. The wall member may comprise a belt, band or other membrane maintained under tension. The member may have a width at least substantially equivalent to the lengths of the articles and could be arranged so that it exerts more control over the ends of the articles at one end than at the other end. For example, the membrane may be maintained under more tension or supported by a backing member along a line corresponding to a position near the tobacco ends of filter cigarettes arranged in the region. The membrane may be under a lesser tension (or not supported by a backing member) in a position corresponding to the filter ends of the cigarettes. In this way the membrane allows the filter ends of the cigarettes to splay upwards or outwards slightly but maintains them under control by virtue of tension in the membrane.

Preferably the boundary means comprises a wall member which, in use, contacts the cigarettes substantially along the whole length of the cigarettes or, alternatively, at least at positions spaced outwardly from the center line of the cigarettes and preferably substantially adjacent to the ends of the cigarettes. For this latter purpose the boundary wall means may comprise separate membranes or the like arranged respectively to contact the cigarettes near the filter and tobacco ends. Where separate membranes or the like are provided it is relatively easy to maintain them under different amounts of tension or even different positions to compensate for tip build-up.

According to another aspect of the invention a conveyor system for rod-like articles, particularly filter cigarettes, comprises boundary defining means for a region through which articles pass in multi-layer stack formation, said boundary defining means including a surface arranged to contact articles at least near their ends and mounted such that the articles may be contacted with their ends in different relative positions. In a preferred arrangement the surface may be relatively fixed along a position corresponding to one end of the articles and relatively movable in a position corresponding to the other end.

According to a further aspect of the invention a conveyor system for rod-like articles in multi-layer stack formation comprises wall means forming a boundary for a region containing rod-like articles in stack formation, said wall means comprising a flexible membrane maintained under tension to restrain and control articles in the region whilst maintaining the capacity of the region relatively constant, and support means allowing differing degrees of movement across the membrane. Preferably the membrane is supported by a relatively rigid member at one side. Where the articles in the region are filter cigarettes the membrane is preferably supported by this rigid member at or near the tobacco ends of the cigarettes, the filter ends of the cigarettes thereby being allowed to splay outwards or upwards slightly.

In a preferred arrangement the region comprises a hopper, which may be the hopper of a tray filling machine, such as Molins TF3. The membrane and the rigid backing member are preferably mounted so that their positions can be adjusted, for example to accommodate different required sizes for the region. Where the region is a hopper of a tray filling machine, for example, the boundary wall or walls may need adjustment for different sizes of tray. For this purpose the backing member may be pivoted and may also be adjustable for length.

Where, in a system according to this invention, it has been mentioned that the boundary wall member is flexible to allow it to expand slightly to accommodate tip build-up it should be realised that the member could be resiliently loaded in an inwards direction relative to the stack of articles in the region. In the arrangement of the invention where a relatively rigid backing member is provided in a position corresponding to the tobacco ends of the cigarettes the filter tip ends are allowed to splay outwards and remain under control of the boundary wall member. In the case of a resiliently-loaded member however, it is possible to position the relatively fixed part of the member (i.e. the rigid backing member) in a position corresponding to the filter ends of the cigarettes: the resiliently-loaded member is then urged inwards to control the tobacco ends of the cigarettes under light pressure.

The invention will be further described, by way of example only, with reference to the accompanying diagrammatic drawings, in which:

FIG. 1 is a diagrammatic view of a hopper constructed in accordance with the present invention; and FIG. 2 is a side view of the hopper as seen in the direction A in FIG. 1.

The drawings show the hopper 10 of a tray filling machine having a shut-off and collator section 12 from which cigarettes are delivered into a tray (not shown). The machine operates to fill trays in substantially the same way as disclosed in British patent specification No. 2124174 or 2140374 to which reference is directed for further details. The machine is similar to Molins TF3 tray filling machine.

Cigarettes are delivered into the hopper 10 to stack formation from one or both sides of the hopper by conveyors 14, 14A. The hopper 10 is symmetrical and its construction will be further described mainly with reference to the right hand side only, it being understood that the left hand side is similar and that similar parts have been given the same reference number with addition of the suffix A.

An inclined stationary plate 16 is arranged near the end of the conveyor 14. At the lower end of the plate 16 is a clamp 18 which holds one end of a belt 20. The belt 20 passes around a spindle 22 located near the lower end of the plate 16 and extends downwards, forming a boundary wall of the hopper 10, to a position at which it is held between a further clamp 24 and fixed lower side guide 26 in the region of the shut-off 12. The belt 20 is maintained under adjustable tension between the clamps 18 and 24, adjustment being made by releasing one clamp and resetting it when the belt is extended at the correct tension.

A rigid backing member 28 has an upper end located on the spindle 22 and a lower end carrying a pin 30 held by a socket formed in an extension 32 of the clamp 24.

The belt 20 is maintained in contact with the inner surface of the member 28 by virtue of the tension in the belt. As can be seen from FIG. 2 the member 28 extends along one edge or side only of the belt 20.

The member 28 is in two longitudinally adjustable parts to accommodate different lengths between the guides 16 and 26. This allows the same member 28 to be used with different sizes of hopper 10, which may be needed for example for different tray widths. The pivotal mounting of the upper and lower ends of the member 28 allows this adjustment of the position of the member 28.

In operation, when filter cigarettes are contained in the hopper 10 with the filter ends of the cigarettes adjacent a rear back-plate of the hopper 10 the tobacco ends of the outermost layers of cigarettes are confined by the belt 20 in contact with the member 28, the filter ends of the cigarettes being allowed to splay outwards by the other side of the belt, the tension in the belt assisting in maintaining control of the cigarettes.

It is possible that filter cigarettes may be contained in the hopper 10 with the tobacco ends towards the rear back-plate of the hopper. In that case the backing member 28 is located on the right hand side of the belt 20 as viewed in FIG. 2.

The hopper 10 contains a flow divider 34. The perimeter of this divider 34 may be formed by a flexible membrane 36 so that some compensation for tip build-up can be provided by the divider 34. In principle, the membrane 36 could be supported asymmetrically with respect to the lengths of the cigarettes in the same way that the member 28 supports the belt 20.

The single wide belt 20 could be replaced by relatively narrow laterally opposed separate belts, indicated at 20A and 20B in FIG. 2, which may be maintained under different tension.

We claim:

1. A conveyor system for rod-like articles, particularly filter cigarettes, which have one end with a larger diameter and/or less compressibility than the rest of the articles so that said articles tend to stack in a non-uniform manner at least in a horizontal plane through the stack resulting in tip build-up, comprising means defining a region through which articles pass in multi-layer stack formation, means for supporting a layer of articles in said region and for establishing an orientation of said layer of articles for supporting other layers of articles in said region, and means defining a boundary of said region at a position spaced from said one layer of articles, said boundary defining means being movable to exert different retaining forces at least at the opposite ends of the adjacent articles so as to compensate for tip build-up between each layer and said boundary means wherein the boundary defining means comprises a wall member which is at least semi-flexible at least in a direction allowing it to move in reaction to said one end of said articles in a direction to accommodate tip build-up, said wall member comprising a membrane, and support means extending along only one side of the membrane along its length for restraining movement of the membrane while, where there is no support means, allowing differential displacement of the membrane along the lengths of the adjacent articles to accommodate deflection due to said one end of said articles.

2. A conveyor system according to claim 1, wherein said support means is positioned to restrict movement of said membrane in reaction to said articles only in an area of the stack formation in which the ends of said articles opposite said one end of the articles is located.

3. A conveyor system according to claim 1, wherein said boundary defining means forms a side wall of said region.

4. A conveyor system according to claim 1, wherein said boundary defining means forms a side wall of said region.

5. A conveyor system for rod-like articles, comprising wall means forming a boundary for a region containing rod-like articles in stack formation, said wall means comprising a flexible membrane maintained under tension to restrain and control articles in the region while maintaining the capacity of the region relatively constant, and support means in contact with said membrane for allowing differing degrees of movement across the membrane by supporting said membrane at one side thereof adjacent one end of the articles and not the other side thereof to permit deflection of said membrane by said one ends of the articles, said support means being arranged assymetrically with respect to a transverse plane passing through the middles of the articles.

6. A conveyor system according to claim 5, wherein the support means comprises a relatively rigid support member along one side of the membrane.

7. A conveyor system according to claim 5, wherein the boundary means is adjustable for length to vary the capacity of the region.

8. A conveyor system according to claim 5, wherein the boundary defining means comprises a wall member which is at least semi-flexible at least in a direction allowing it to move in reaction to said one end of said articles in a direction to accommodate tip build-up.

9. A conveyor system according to claim 8, wherein the wall member comprises at least one membrane, and support means in contact with the membrane for allowing differential displacement of the membrane or membranes along the lengths of the adjacent articles.

10. A conveyor system for rod-like articles, comprising wall means forming a boundary for a region containing rod-like articles in stack formation, said wall means comprising a flexible membrane maintained under tension to restrain and control articles in the region while maintaining the capacity of the region relatively constant, and support means allowing differing degrees of movement across the membrane, wherein the wall means is resilient, including means for maintaining different parts of said wall means under different tensions.

11. A conveyor system according to claim 10, wherein said boundary means is self-adjusting to provide a degree of control over the stack formation at the angle at which tip build-up occurs from layer to layer.

12. A conveyor system for rod-like articles, particularly filter cigarettes, comprising means defining a region through which articles pass in multi-layer stack formation, and means defining a boundary of said region, said boundary means comprising a wall member having a first part located along a first line extending adjacent first ends of the articles and a second part located along a second line extending adjacent second ends of the articles, and means for maintaining said first and second parts under different degrees of tension so as to provide different degrees of possible movement, whereby said first and second lines, at least in use, are respectively spaced by different distances from the first and second ends of articles.

13. A conveyor system as claimed in claim 12, wherein said wall member includes means extending between said first and second parts and lying generally in a plane which is inclined to a plane containing a layer of articles.

* * * * *